US007635254B2

(12) United States Patent
Kunz et al.

(10) Patent No.: US 7,635,254 B2
(45) Date of Patent: Dec. 22, 2009

(54) MOBILE PUMP

(75) Inventors: James F. Kunz, Albuquerque, NM (US); Doug Eligur, Albuquerque, NM (US); Philip Funk, Rio Rancho, NM (US)

(73) Assignee: Mega Corp, Inc., Albuquerque, NM (US)

( * ) Notice: Subject to any disclaimer, the term of this patent is extended or adjusted under 35 U.S.C. 154(b) by 214 days.

(21) Appl. No.: 10/899,836

(22) Filed: Jul. 26, 2004

(65) Prior Publication Data

US 2005/0053477 A1 Mar. 10, 2005

Related U.S. Application Data

(60) Provisional application No. 60/490,396, filed on Jul. 25, 2003.

(51) Int. Cl.
*F04B 53/00* (2006.01)
*B65G 21/10* (2006.01)

(52) U.S. Cl. ..... 417/234; 198/313; 198/318

(58) Field of Classification Search ..... 417/234, 417/231, 572; 285/272; 60/398; 414/523; 198/312–318

See application file for complete search history.

(56) References Cited

U.S. PATENT DOCUMENTS 3,008,422 A * 11/1961 Crisafulli ..... 417/234
4,130,134 A * 12/1978 Castle ..... 137/615
6,401,829 B1 * 6/2002 Newton ..... 169/24
6,701,980 B2 * 3/2004 Rothrock ..... 141/231

OTHER PUBLICATIONS

"Hurrican Bravo" promotional brochure, undated, Klein Products, Inc., Ontario, CA.
"Klein Hurricane Pump" promotional brochure, undated, Klein Products, Inc., Ontario, CA.
"Pumpmaster" promotional brochure, undated, RH Gorman Co., Hayward, CA.

* cited by examiner

*Primary Examiner*—Charles G Freay
(74) *Attorney, Agent, or Firm*—Richard E. Oney; Tiffany & Bosco, P.A.

(57) ABSTRACT

A mobile pump system includes a wheeled trailer adapted to transport the mobile pump system. Mounted to the trailer are a hydraulic fluid supply system, a power source and an adjustable pipe system that includes a discharge pipe section, an intake pipe section and a swivel section coupled between the intake pipe section and the discharge pipe section. The swivel pipe section allows the discharge pipe section and the intake pipe section to be pivoted independently of each other. Hydraulic cylinders and extensible pivot arms pivot the discharge pipe section and the intake pipe section so that they can be positioned at various angles with respect to the trailer frame. A submersible hydraulic pump is mounted to the intake pipe section and is driven by the power source and hydraulic fluid supply system.

20 Claims, 10 Drawing Sheets

MOBILE PUMP

RELATED APPLICATION DATA

This application is based on and claims the benefit of U.S. Provisional Patent Application No. 60/490,396 filed on Jul. 25, 2003, the disclosure of which is incorporated herein by this reference.

BACKGROUND

This invention relates to systems for removing water from a body of water, such as a pond, canal or ditch, and discharging the water at another position. More particularly, it relates to an engine-driven, trailer-mounted, high volume axial-flow water pump for use in loading water haulage equipment from a pond, canal or ditch.

Previously, mobile water haulage equipment has been loaded with water using a suction-loading pump permanently attached to a water haulage vehicle. This approach however, has presented a number of drawbacks. The mechanically driven water pumps used for this purpose require a rigid connection between the engine and pump. This rigid mechanical connection prevents the pump from being positioned at varying angles to the engine and therefore presents operating angle limitations. The entire mechanically driven pump system (including engine, trailer, etc.) must be positioned at the desired operating angle to the water source for proper operation. This often requires excavation of the berm along the pond or ditch being used as a source of water. If the water level or height of equipment being loaded changes, the entire system may need to be repositioned. In addition, portions of prior mechanical drive systems must operate below the water level, prompting frequent maintenance. Moreover, the rigid connection must be disconnected for transportation and then reconnected again for operation—requiring the time of a skilled mechanic. Also, previous systems are restricted to slow speed transportation and do not have a braking system.

It is an object of the present invention, therefore, to provide an improved engine-driven, trailer-mounted, high volume water pump for use in loading water haulage equipment from ponds or ditches.

Another object of the invention is to provide a pump that overcomes the operating angle limitations of the existing pumps by providing an improved range of possible operating angles for the pump system, thereby eliminating the need to excavate the area around the pump system prior to operation or during operation if the required operating angle changes.

Still another object of the invention is to provide a pump that requires reduced maintenance compared to partially-submerged mechanically drive system components found on existing mechanically-driven pumps.

Yet another object of the invention is to provide a pump system that does not require a skilled mechanic to disassemble it for transportation and to reassemble it prior to operation and that eliminates the need for human-powered mechanical winches for raising or lowering portions of the pump system.

Another object of the invention is to provide a trailer system capable of operation on the highway at normal highway speeds.

Additional objects and advantages of the invention will be set forth in the description that follows, and in part will be apparent from the description, or may be learned by practice of the invention. The objects and advantages of the invention may be realized and obtained by the instrumentalities and combinations pointed out herein.

SUMMARY

To achieve the foregoing objects, and in accordance with the purposes of the invention as embodied and broadly described in this document, there is provided a mobile pump system including a wheeled trailer having a trailer frame and being adapted to transport the mobile pump system from one location to another. A self-contained power source is mounted to the trailer. A hydraulic fluid supply system is mounted to the trailer and powered by the power source. An adjustable pipe system includes a discharge pipe section, an intake pipe section and a swivel section mounted to the trailer frame and coupled between the intake pipe section and the discharge pipe section. The swivel pipe section allows the discharge pipe section to be pivoted about a discharge pipe pivot point that is fixed with respect to the trailer frame and allows the intake pipe section to be pivoted about an intake pipe pivot point that is fixed with respect to the trailer frame. A submersible hydraulic pump is mounted to the intake pipe section and is driven by the power source and hydraulic fluid supply system. The system includes a hydraulic cylinder and extensible pivot arm actuated by the hydraulic cylinder. The pivot arm is pivotally coupled to the discharge pipe section so that as the pivot arm is extended and retracted the discharge pipe section pivots about the discharge pipe pivot point, whereby the discharge pipe section can be positioned at various angles with respect to the trailer frame. The system also includes a second hydraulic cylinder and extensible pivot arm actuated by the pivot cylinder. The second pivot arm is pivotally coupled to the intake pipe section so that as the pivot arm is extended and retracted the intake pipe section pivots about the intake pipe pivot point, whereby the intake pipe section can be positioned at various angles with respect to the trailer frame. The hydraulic fluid supply system includes a control valve assembly configured to control and maintain the supply of hydraulic fluid in the hydraulic cylinders and hydraulic pump.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred methods and embodiments given below, serve to explain the principles of the invention.

DESCRIPTION

Figure 1:
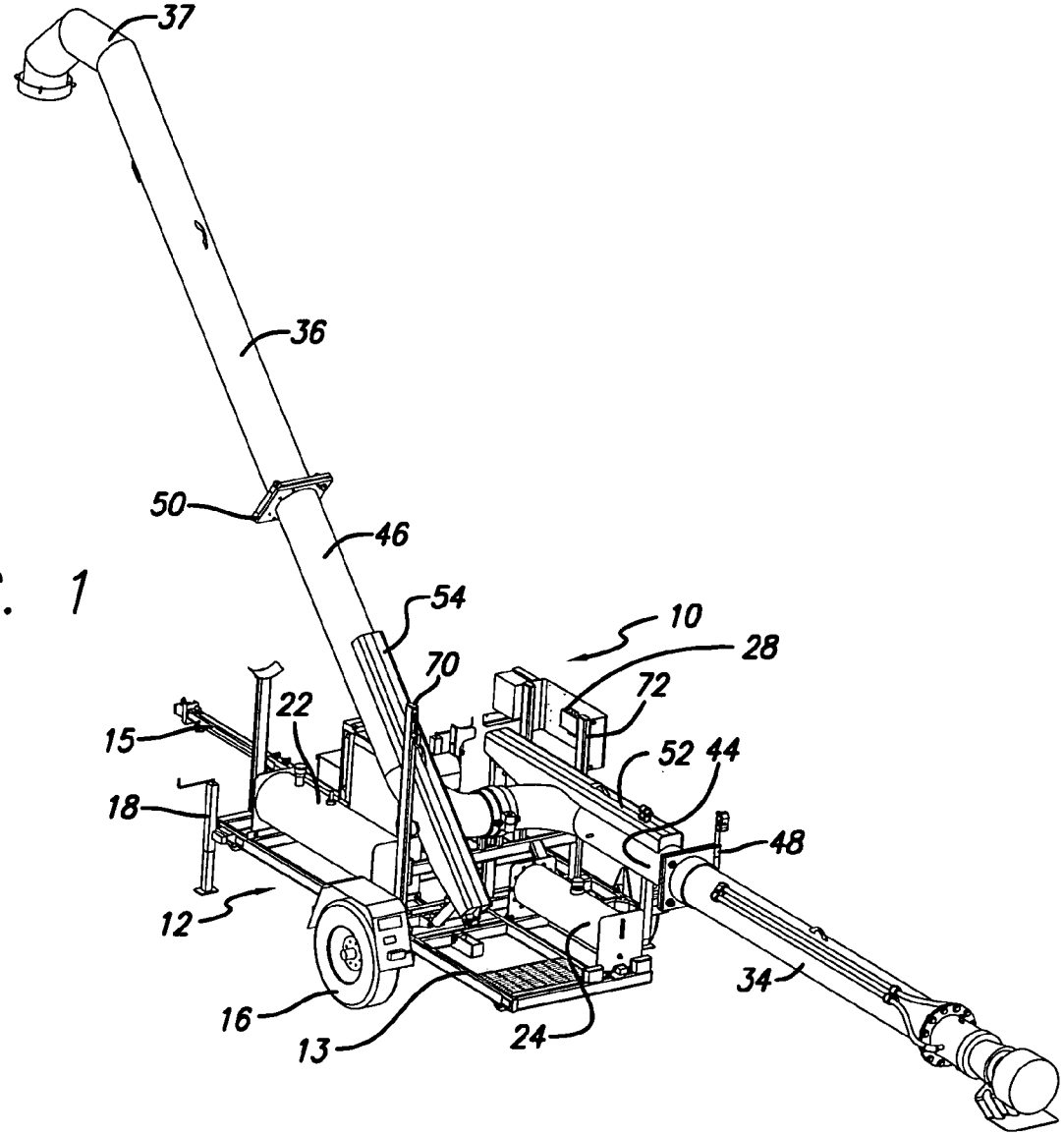
FIG. 1 is a perspective view of a presently preferred embodiment of a mobile water pump system according to the invention, showing the pump system in an operating configuration.
Figure 2:
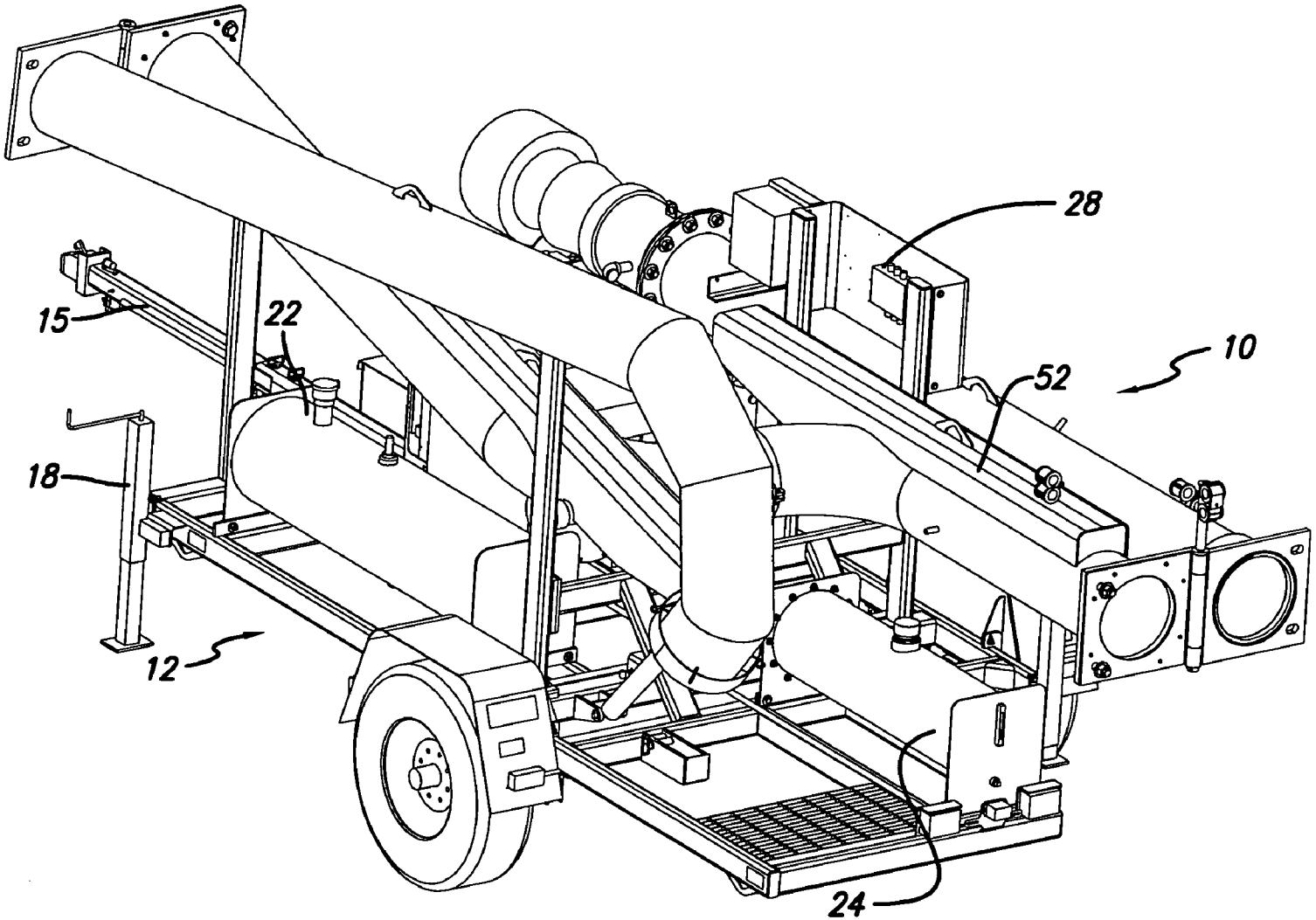
FIG. 2 is a perspective view of the mobile water pump system of FIG. 1, showing the pump system in a transport configuration.

Referring to the accompanying drawings, the mobile pump system of the present invention is shown generally at 10. The system is self-contained and is mounted on a movable trailer 12. The trailer 12 includes a frame 13, an axle assembly 14, which includes wheels, suspension and braking systems, and a tow bar 15, to facilitate its being towed by a truck, tractor or other vehicle. Tires 16 mounted on the axle assembly 14 are preferably highway or off road tires 16, which allow the trailer 12 to be towed at highway speeds. The wheeled axle preferably includes the braking system to facilitate transporting the mobile pump system 10 on the highway. Adjustable jack supports 18 are fixed to the trailer frame 13 and support and stabilize the trailer 12 when the pump system 10 is placed in an operating configuration for pumping, as shown in FIG. 1. Each of the jack supports 18 can be extended to contact the ground to stabilize the trailer 12 and can be retracted to clear the ground when the pump system is being transported, as shown in FIG. 2.

The mobile pump system 10 has a self-contained power source including an engine 20 and fuel tank 22 for supplying fuel to the engine 20, which are mounted on the trailer 12. Preferably, the engine 20 is a diesel engine and the fuel tank has a capacity of at least fifty gallons. A reservoir of hydraulic fluid 24, a hydraulic pump 26, hydraulic fluid supply conduits and a hydraulic control valve assembly 28 provide hydraulic fluid to all the hydraulically activated mechanisms throughout pump system 10, as will be described, including hydraulic lifting cylinders 60, 64. The hydraulic system uses an environmentally friendly hydraulic fluid to prevent contamination of the water source.

Also mounted on the trailer frame 13 is a water pipe system 30 that forms the conduit though which water flows when the mobile pump system 10 is in the operating configuration shown in FIG. 1. The water pipe system 30 generally includes an intake pipe section 34, a discharge pipe section 36 and a center swivel section 38. The intake pipe section 34 has an intake end 40 that can be lowered into a water source 100, as described below. The hydraulically driven submersible pump 26 is positioned near intake end 40 of the intake pipe section 34. Preferably, the pump 26 is an axial flow pump or mixed flow pump. However, the pump 26 may be any hydraulically driven, submersible pump. The discharge pipe section 36 serves as a chute for discharging water through a discharge end 37 to load a water haulage truck or other mobile water storage or hauling equipment. In the operating configuration, the center swivel section 38 is coupled to the intake pipe section 34 and discharge pipe section 36 to form a conduit so that water pumped by the pump 26 into the intake end 40 flows through the water pipe system 30 and out the discharge end 37. In addition, the center swivel section 38 serves as a swivel for each of the intake pipe section 34 and discharge pipe section 36, as described below, allowing for the angular position of the intake pipe section 34 and the angular position of the discharge pipe section 36 to be adjusted independently of each other.

Figure 9:
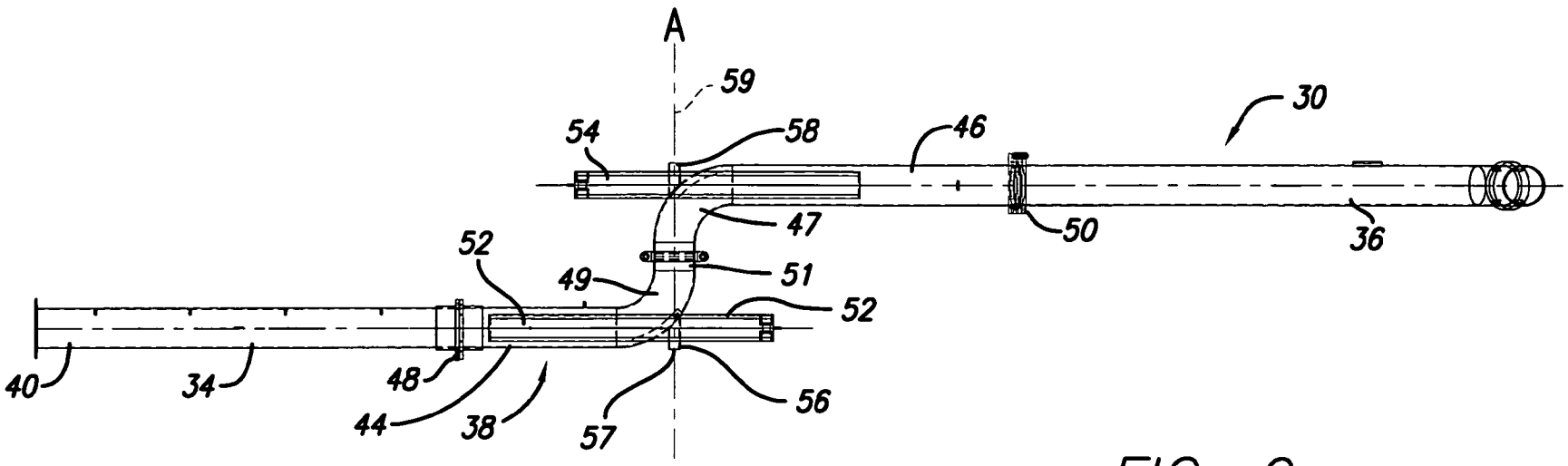
FIG. 9 is a top plan view of the water pipe system in the operating configuration.
Figure 10:
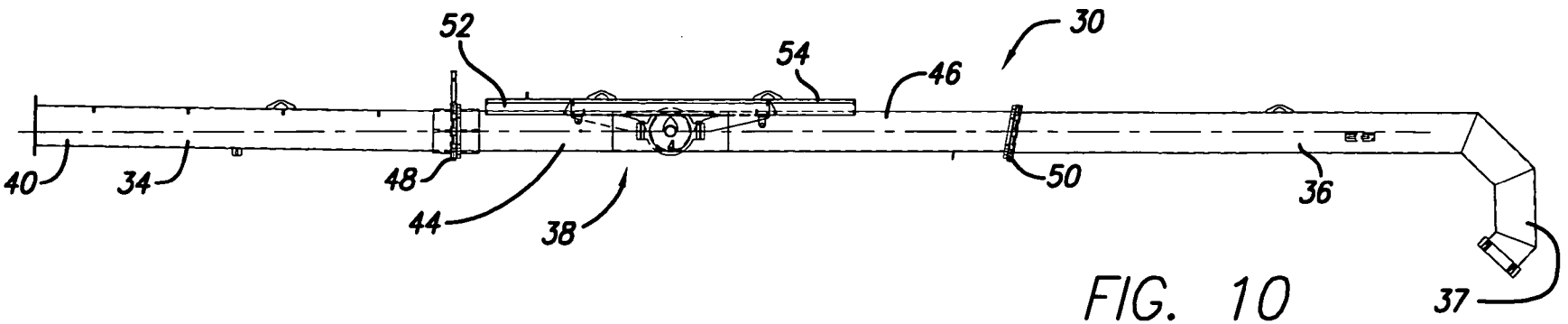
FIG. 10 is a side elevation of the water pipe system in the operating configuration.

The center swivel section 38 is mounted to and carried by the trailer frame 13, as described below. Referring to FIGS. 9 and 10, the center swivel section 38 is a generally S-shaped pipe, having an elongated, generally straight intake leg 44 and an elongated, generally straight discharge leg 46. The intake leg 44 has a 90° elbow section 49 on one end and a hinged flange assembly 48 on the other end. The intake leg 44 is coupled to the intake pipe section 34 via the hinged flange assembly 48, which allows for the intake pipe section 34 to be rotated between a closed position in the operating configuration shown in FIG. 1 and an open position shown in FIG. 2. In the closed position, the hinged flange assembly 48 can be locked so that the intake pipe section 34 forms a sealed connection with the intake leg 44 for pumping water through the water pipe system 30. Similarly, the discharge leg 46 has a 90° elbow section 47 on one end and a hinged flange assembly 50 on the other end. The discharge leg 46 is coupled to the discharge pipe section 36 via the hinged flange assembly 50, which allows for the discharge pipe section 36 to be rotated between a closed position in the operating configuration shown in FIG. 1 and an open position shown in FIG. 2. In the closed position, the hinged flange assembly 50 can be locked so that the discharge pipe section 36 forms a sealed connection with the discharge leg 46 for pumping water through the water pipe system 30. The elbow sections 47, 49 have a circular cross-section and are coupled together using a Victaulic coupling 51. The trailer frame 13 includes a cross-member 42 that cradles the elbow sections 47, 49 and Victaulic coupling 51 and thereby supports the center swivel section 38. Angular adjustment of each of the elbow sections 47, 49 about an axis A (which is perpendicular to the plane in which the joint between the elbow sections 47, 49 lies) can be easily achieved by loosening the Victaulic coupling 51 and rotating the legs 44, 46. After the desired angular position is achieved, the Victaulic coupling 51 can be tightened to provide a seal to restrict water from leaking through the joint.

Figure 3:
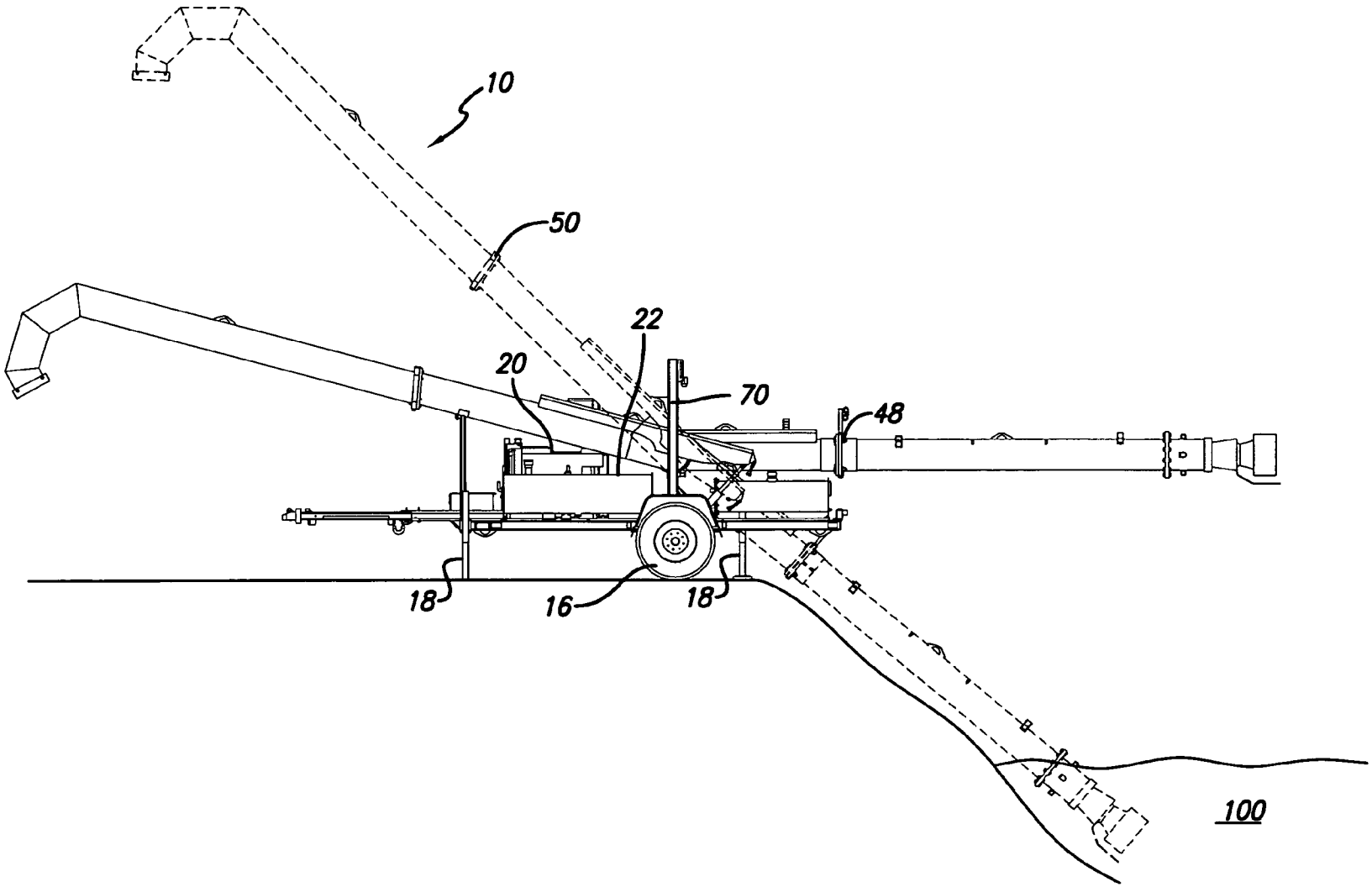
FIG. 3 is a side elevation of the mobile water pump system of FIG. 1 in the operating configuration and positioned to pump water from a pond into a water haulage vehicle.
Figure 4:
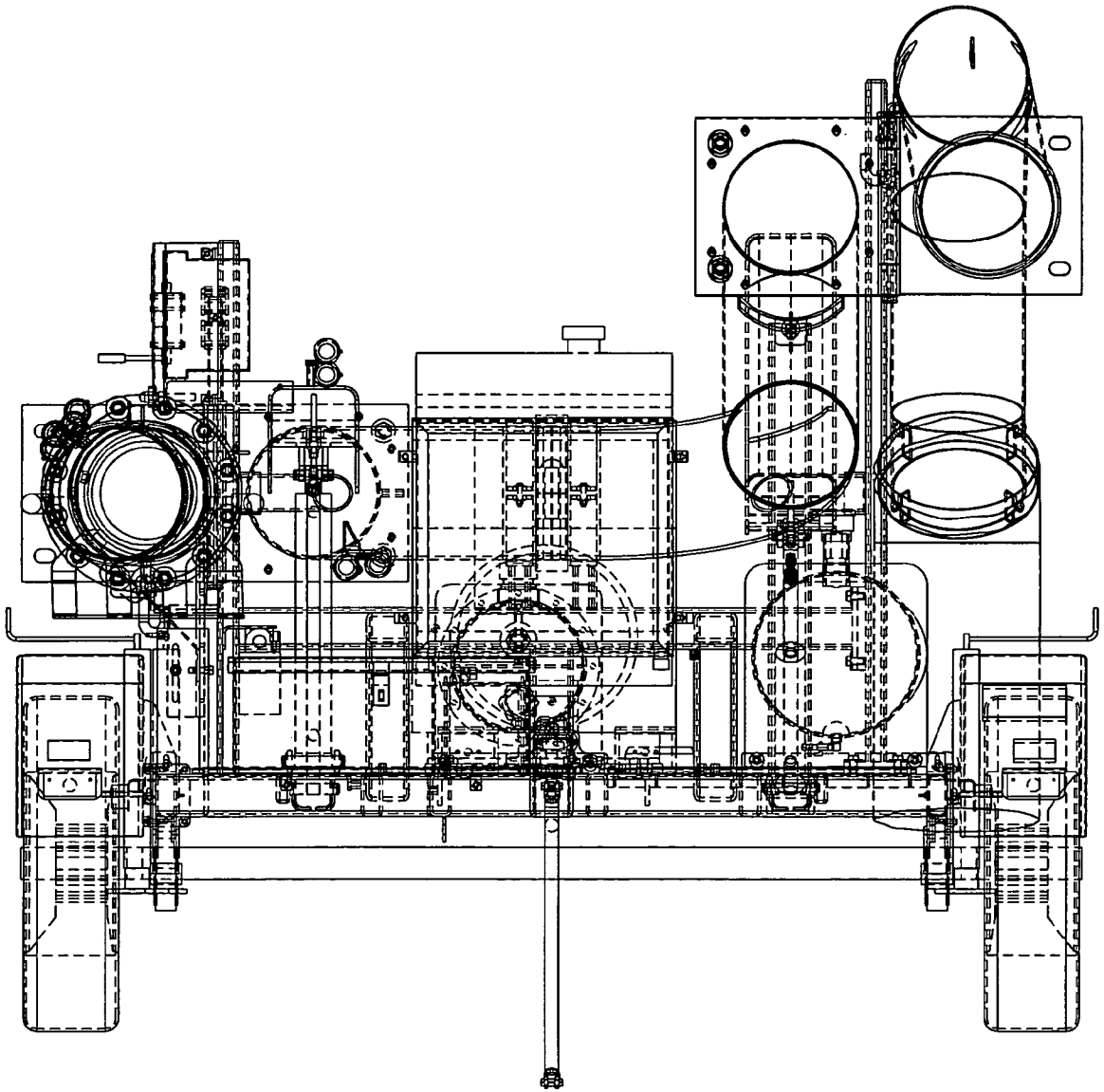
FIG. 4 is a front elevation of the mobile water pump system of FIG. 1 in the transport configuration.
Figure 5:
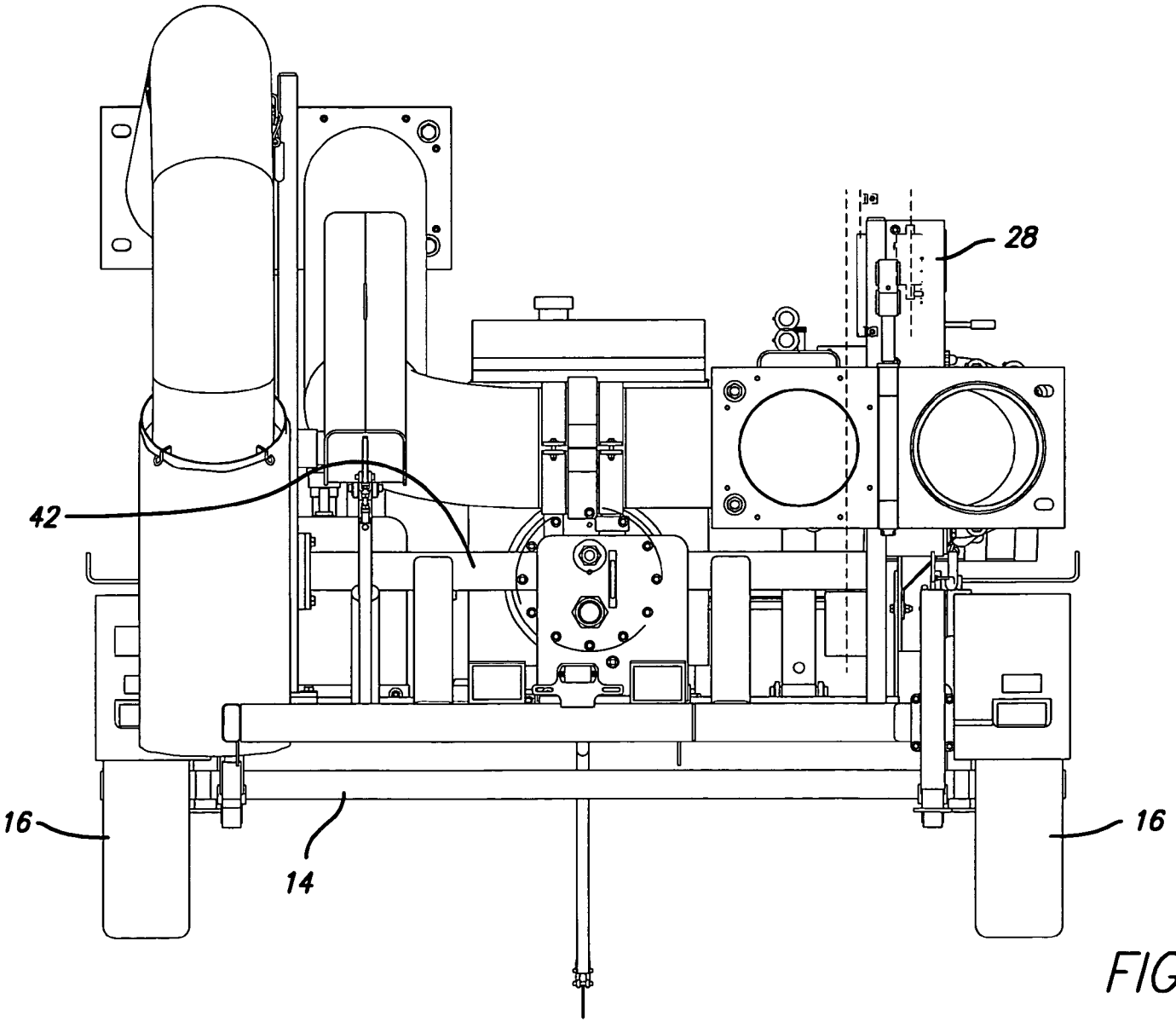
FIG. 5 is a rear elevation of the mobile water pump system of FIG. 1 in the transport configuration.

Still referring to FIGS. 9 and 10, a boom or cantilever arm 52 is secured to the top of and extends along a portion of the axial length of intake leg 44. Similarly, a cantilever arm 54 is secured to the top of and extends along a portion of the axial length of discharge leg 46. Each of the cantilever arms 52, 54 has a cross-section generally in the form of an inverted U and is rigidly secured to the its respective leg 44, 46, preferably by welding although it may be secured by any other suitable technique such as bolts or other connecting means. A pivot rod 56 is rigidly fixed to the intake elbow 49 and the cantilever arm 52 such that it projects from below the intake cantilever arm 52 along an axis that is generally perpendicular to the longitudinal axis of the intake leg 44. The pivot rod 56 defines a pivot point 57 about which the intake cantilever arm 52 and the intake pipe section 34 are pivotable. Similarly, a pivot rod 58 is rigidly fixed to the discharge elbow 47 and the discharge cantilever arm 54 such that it projects from below the discharge cantilever arm 54 along an axis that is generally perpendicular to the longitudinal axis of the discharge leg 46. The pivot rod 58 defines a pivot point 59 about which the discharge cantilever arm 54 and the discharge pipe section 36 are pivotable. In a preferred embodiment, each of the pivot rods 56, 58 comprises a section of pipe that is welded to its respective elbow 49, 47 and extends through and is welded to a lower portion of its respective cantilever arm 52, 54. As shown in FIGS. 1-3, the trailer frame 13 includes upright members 70, 72, which receive and act as bearings for the pivot rods 56, 58, respectively, at pivot points 57, 59, respectively. In this configuration, each of the legs 44, 46 of the center swivel section 38 can be swiveled about its respective pivot point 57, 59 independently of the other leg for angular adjustment of the legs with respect to the trailer frame 13.

Figure 6:
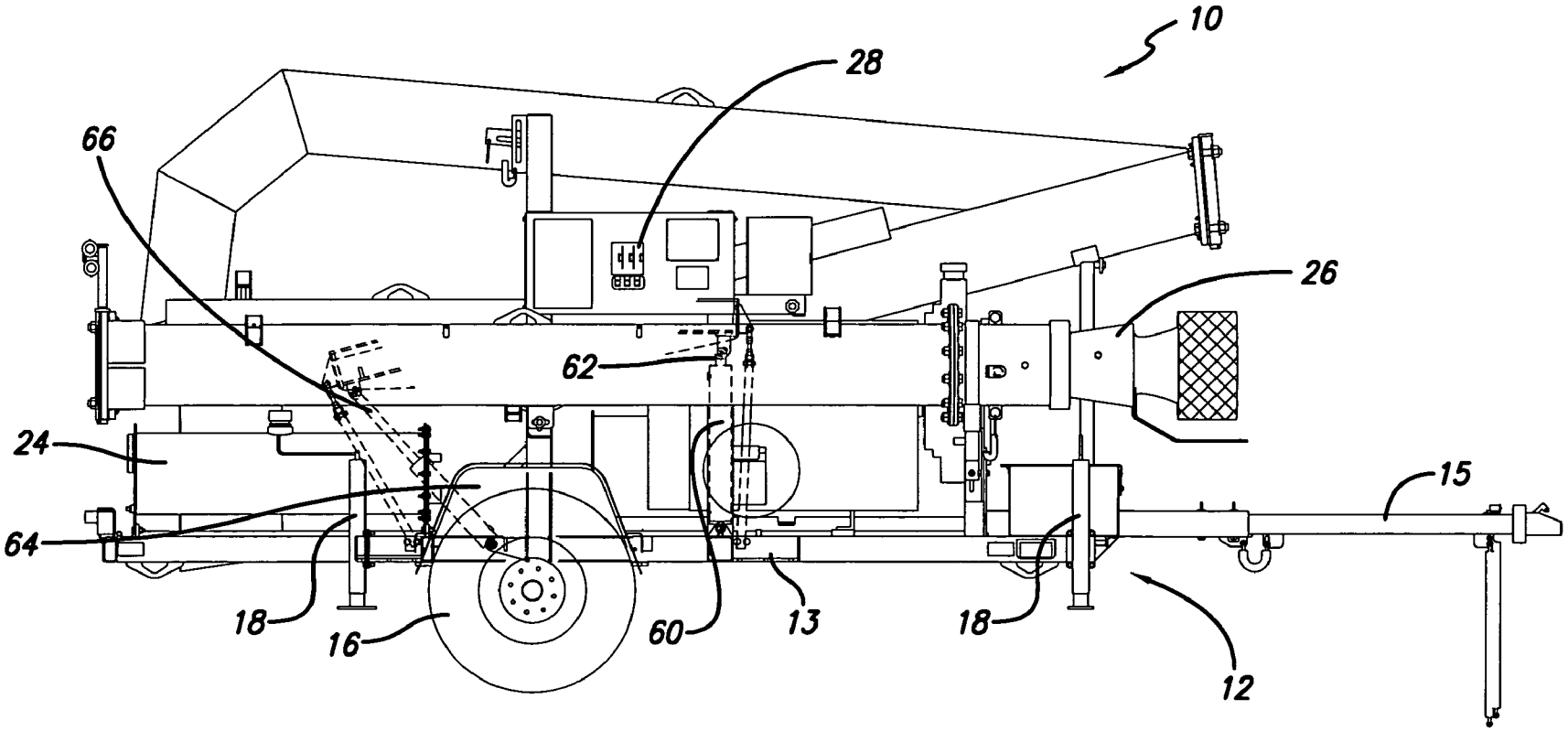
FIG. 6 is a left side elevation of the mobile water pump system of FIG. 1 in the transport configuration.

A hydraulic pivot actuating system serves to pivot the intake cantilever arm 52 and the attached intake pipe section 34 about the pivot point 57. As shown in FIG. 6, the pivot actuating system includes a hydraulic cylinder 60 and an extensible pivot arm 62 actuated by the hydraulic cylinder 60. The hydraulic cylinder 60 is pivotably connected to the trailer frame 13. The pivot arm 62 is pivotably connected to the intake cantilever arm 52 so that as the pivot arm 62 is extended and retracted, the intake cantilever arm 52 and the intake pipe section 34 are rotated about pivot point 57. Hydraulic fluid pumped by the hydraulic pump 11 from the reservoir 24 is carried to the hydraulic cylinder 60 by hydraulic supply lines. Referring to FIG. 3, as the pivot arm 62 is extended by the hydraulic cylinder 60, the intake cantilever arm 52 and the intake pipe section 34 are rotated in a clockwise direction about the pivot point 57, thus forcing the intake end 40 of the intake pipe section 34 to descend and angle downwardly into its operating position. As the hydraulic cylinder 60 retracts the pivot arm 57, the cantilever arm 52 and the intake pipe section 34 are rotated about the pivot point 57 in a counterclockwise direction thus driving the intake end 36 towards a more horizontal position out of the water 100.

Figure 7:
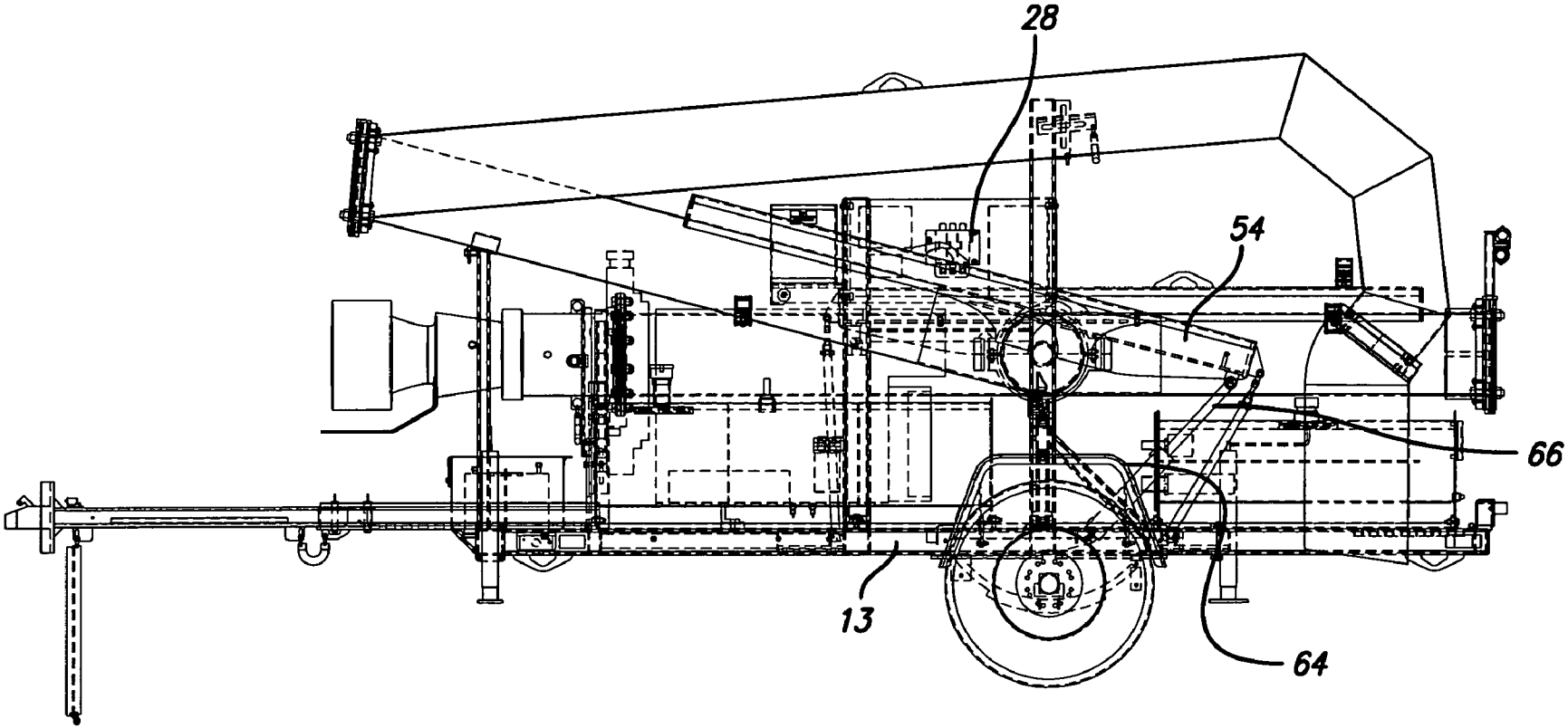
FIG. 7 is a right side elevation of the mobile water pump system of FIG. 1 in the transport configuration.
Figure 8:
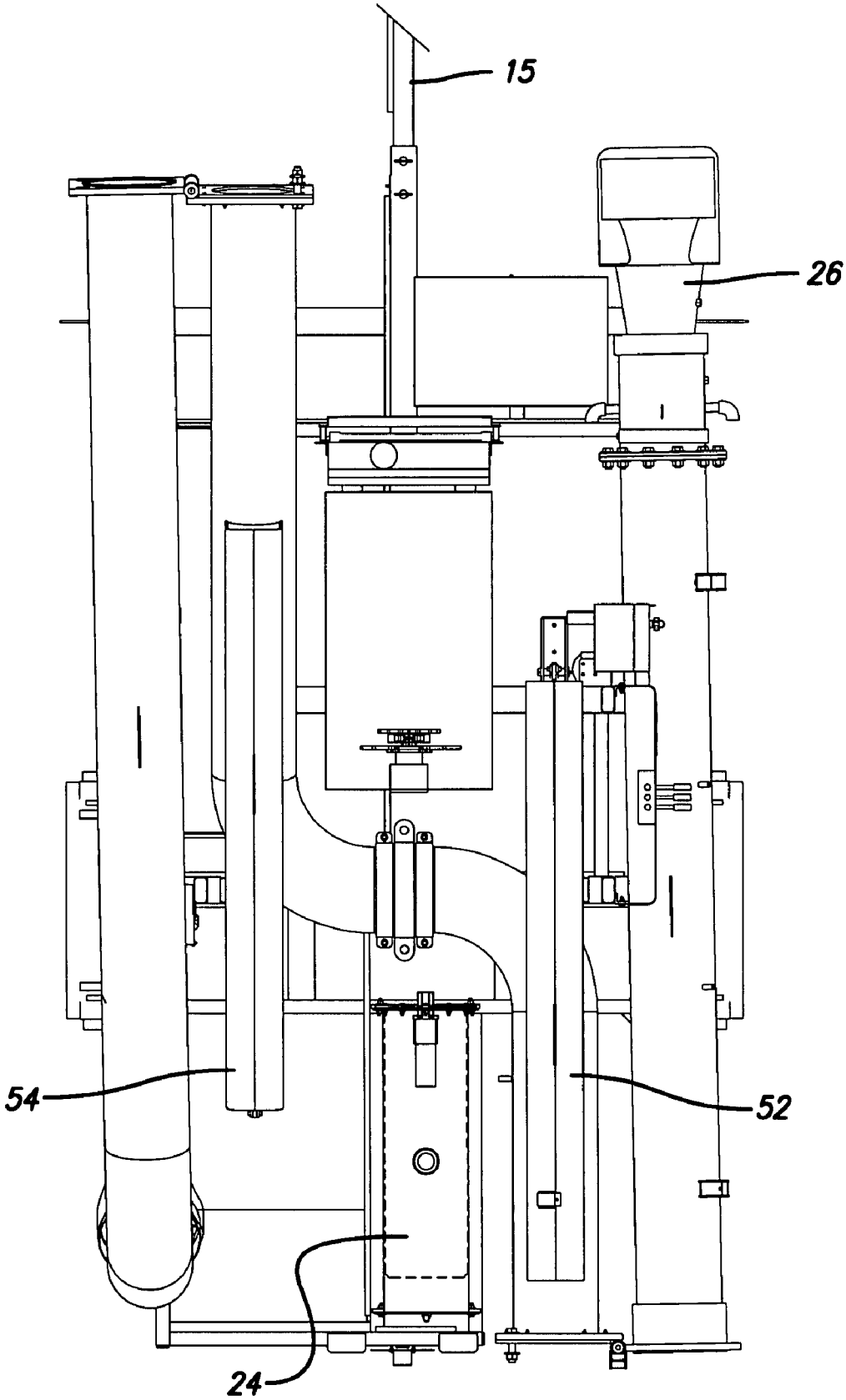
FIG. 8 is a top plan view of the mobile water pump system of FIG. 1 in the transport configuration.

Similarly, the hydraulic pivot actuating system serves to pivot the discharge cantilever arm 54 and the attached discharge pipe section 36 about the pivot point 59. As shown in FIG. 7, the pivot actuating system includes a hydraulic cylinder 64 and an extensible pivot arm 66 actuated by the hydraulic cylinder 64. The hydraulic cylinder 64 is pivotably connected to the trailer frame 13. The pivot arm 66 is pivotably connected to the discharge cantilever arm 54 so that as the pivot arm 66 is extended and retracted, the discharge cantilever arm 54 and the discharge pipe section 36 are rotated about pivot point 59. Hydraulic fluid pumped by the hydraulic pump 11 from the reservoir 24 is carried to the hydraulic cylinder 64 by hydraulic supply lines. Referring again to FIG. 3, as the pivot arm 66 is retracted by the hydraulic cylinder 64, the discharge cantilever arm 54 and the discharge pipe section 36 are rotated in a clockwise direction about the pivot point 59, thus forcing the discharge end 37 of the discharge pipe section 36 to ascend and angle upwardly into its operating position. As the hydraulic cylinder 64 extends the pivot arm 66, the cantilever arm 54 and the discharge pipe section 36 are rotated about the pivot point 59 in a counterclockwise direction thus driving discharge end 37 downward.

Figure 11:
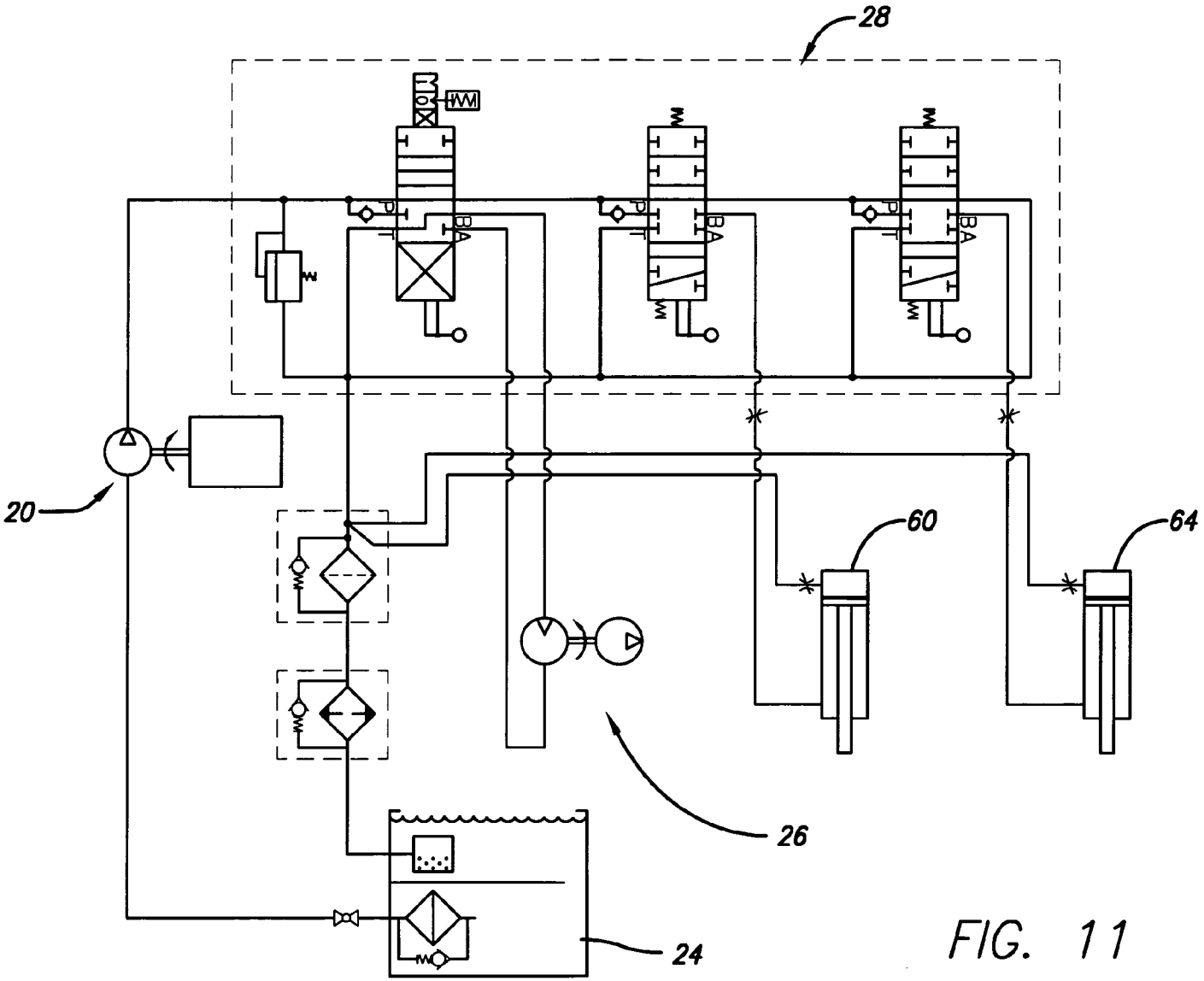
FIG. 11 is a schematic diagram of the hydraulic system of the water pump system of FIG. 1.

Referring to FIG. 11, a schematic diagram of the hydraulic system is shown. The hydraulic pump 26 pumps hydraulic fluid from reservoir 24 to the control valve assembly 28 to the pump 26 or returns fluid to the reservoir 24. The control valve assembly 28 can be selectively actuated to divert hydraulic fluid through appropriate conduits to the desired hydraulic auxiliary system of pump system 10, i.e. the intake boom cylinder 60 and the discharge boom cylinder 64. When the desired auxiliary hydraulic system has been fully actuated the control valve assembly can be actuated to lock hydraulic pressure in the fully actuated system and to divert hydraulic fluid to the hydraulic pump 26.

To pump water 100 from a pond or similar water source into a water hauling vehicle, the mobile water pump system 10 is placed in the operating configuration shown in FIG. 1. The hinged flanges 48, 50 are closed and locked. The hydraulic system can be used to independently adjust the angular position of the intake pipe section 34 and the discharge pipe section 36 while the trailer 12 remains fixed. To transport the water pump system 10, it is placed into the transport configuration shown in FIG. 2. In this configuration, the hinged flanges 48, 50 are open. The angular positions of the intake pipe section 34 and the discharge pipe section 36 are adjusted so that the intake pipe section 34 and discharge pipe section 36 each rest in a generally vertical position on the trailer frame when the intake pipe section 34 and discharge pipe section 36 are folded back and held in position on the trailer frame 13.

From the foregoing, it can be seen that a pump system as disclosed herein presents a number of advantages. Among other advantages, by utilizing a hydraulically driven water pump instead of a mechanically-driven water pump, the pump is free to move relative to the engine and trailer. Thus, the hydraulically operated pump can be positioned at various angles while the engine remains level. Independent adjustment of the operating angles of the intake pipe section and the discharge pipe section can be achieved. The use of hydraulic controls, rather than human-powered mechanical winches, provides for convenient adjustment of the pumping system to adapt to varying terrain. The pump can remain intact for transport. The trailer is capable of operation at highway speeds and includes a hydraulic braking system. The system can be used to fill mobile water haulage equipment in remote locations not serviced by a pressurized water system.

While certain preferred embodiments and methods of the invention have been described, these have been presented by way of example only, and are not intended to limit the scope of the present invention. Additional advantages and modifications will readily occur to those skilled in the art. Therefore, the invention in its broader aspects is not limited to the specific embodiments, methods and conditions described herein, which are not meant to and should not be construed to limit the scope of the invention. Accordingly, departures may be made from such embodiments and methods, variations may be made from such conditions, and deviations may be made from the details described herein without departing from the spirit or scope of the general inventive concept as defined by the appended claims and their equivalents.

What is claimed is:

1. A mobile pump system comprising:

a wheeled trailer including a trailer frame, wherein the trailer is adapted to transport the mobile pump system from one location to another;

a power source mounted to the trailer;

a hydraulic fluid supply system mounted to the trailer and powered by the power source;

an adjustable pipe system including a discharge pipe section, an intake pipe section and a swivel section mounted to the trailer frame and coupled between the intake pipe section and the discharge pipe section, wherein the swivel section:

allows the discharge pipe section to be pivoted, independently of the intake pipe section, about a discharge pipe pivot point that is fixed with respect to the trailer; and allows the intake pipe section to be pivoted, independently of the discharge pipe section, about an intake pipe pivot point that is fixed with respect to the trailer frame;

a submersible hydraulic pump mounted to the intake pipe section and driven by the power source;

a first extensible pivot arm actuated by a first hydraulically actuated pivot cylinder, wherein the first pivot arm is pivotally coupled to the discharge pipe section so that as the first pivot arm is extended and retracted the discharge pipe section pivots about the discharge pipe pivot point, whereby the discharge pipe section can be positioned at various angles with respect to the trailer frame; and a second extensible pivot arm actuated by a second hydraulically actuated pivot cylinder, wherein the second pivot arm is pivotally coupled to the intake pipe section so that as the second pivot arm is extended and retracted the intake pipe section pivots about the intake pipe pivot point, whereby the intake pipe section can be positioned at various angles with respect to the trailer frame;

wherein the hydraulic fluid supply system includes a control valve assembly configured to control and maintain the supply of hydraulic fluid in the hydraulic cylinders.

2. The mobile pump system of claim 1 wherein the power source is self-contained.

3. The mobile pump system of claim 1 wherein the discharge pipe section and the intake pipe section can be positioned at various angles with respect to the trailer frame independently of each other.

4. A mobile pump system comprising:

a wheeled trailer including a trailer frame , wherein the trailer is adapted to transport the mobile pump system from one location to another;

a power source mounted to the trailer;

a hydraulic fluid supply system mounted to the trailer and powered by the power source;

an adjustable pipe system including a discharge pipe section, an intake pipe section and a swivel section mounted to the trailer frame and coupled between the intake pipe section and the discharge pipe section, the swivel section allowing the discharge pipe section to be pivoted about a discharge pipe pivot point that is fixed with respect to the trailer and allowing the intake pipe section to be pivoted about an intake pipe pivot point that is fixed with respect to the trailer frame;

a submersible hydraulic pump mounted to the intake pipe section and driven by the power source;

a first extensible pivot arm actuated by a first hydraulically actuated pivot cylinder, wherein the first pivot arm is pivotally coupled to the discharge pipe section so that as the first pivot arm is extended and retracted the discharge pipe section pivots about the discharge pipe pivot point, whereby the discharge pipe section can be positioned at various angles with respect to the trailer frame; and a second extensible pivot arm actuated by a second hydraulically actuated pivot cylinder, wherein the second pivot arm is pivotally coupled to the intake pipe section so that as the second pivot arm is extended and retracted the intake pipe section pivots about the intake pipe pivot point, whereby the intake pipe section can be positioned at various angles with respect to the trailer frame;

wherein the hydraulic fluid supply system includes a control valve assembly configured to control and maintain the supply of hydraulic fluid in the hydraulic cylinders;

the discharge pipe section rotates along a first plane as the discharge pipe section pivots about the discharge pipe pivot point;

the intake pipe section rotates along a second plane as the intake pipe section pivots about the intake pipe pivot point; and the first and second planes are substantially parallel.

5. The mobile pump system of claim 1 wherein the hydraulic fluid supply system includes a control valve assembly configured to control and maintain the supply of hydraulic fluid in the hydraulic pump.

6. The mobile pump system of claim 1 wherein the swivel section comprises:

a first 90-degree elbow section having a discharge leg coupled to the discharge pipe section;

a second 90 degree elbow section having an intake leg coupled to the intake pipe section; and a coupling between the first 90-degree elbow section and the second 90-degree elbow section wherein the first and second 90-degree elbow sections can be rotated relative to each other.

7. A mobile pump system comprising:

a wheeled trailer including a trailer frame;

an adjustable pipe system including a discharge pipe section, an intake pipe section and a swivel section mounted to the trailer frame and coupled between the intake pipe section and the discharge pipe section, wherein the swivel section allows the discharge pipe section to be pivoted, independently of the intake pipe section, about a discharge pipe pivot axis that is fixed with respect to the trailer frame and allows the intake pipe section to be pivoted, independently of the discharge pipe section, about an intake pipe pivot axis that is fixed with respect to the trailer frame; and a submersible pump mounted to the intake pipe section;

wherein at least one of the intake pipe section and the discharge pipe section includes a hinge for allowing the pipe section to be rotated between a first position for pumping operation and a second position for transportation.

8. The mobile pump system of claim 7 further comprising:

a hydraulic fluid supply system mounted to the trailer frame, wherein the hydraulic fluid system supplies hydraulic fluid to a first hydraulically actuated pivot cylinder and a second hydraulically actuated pivot cylinder;

a first extensible pivot arm actuated by the first hydraulically actuated pivot cylinder, wherein the first pivot arm is pivotally coupled to the discharge pipe section so that as the first pivot arm is extended and retracted the discharge pipe section pivots about the discharge pipe pivot axis; and a second extensible pivot arm actuated by the second hydraulically actuated pivot cylinder, wherein the second pivot arm is pivotally coupled to the intake pipe section so that as the second pivot arm is extended and retracted the intake pipe section pivots about the intake pipe pivot axis;

whereby the discharge pipe section and the intake pipe section can be hydraulically positioned, independently of each other, at various angles with respect to the trailer frame.

9. The mobile pump system of claim 7 further comprising:

a hydraulic fluid supply system mounted to the trailer frame;

wherein the submersible pump is a hydraulic pump and the hydraulic fluid supply system supplies hydraulic fluid to the submersible pump.

10. The mobile pump system of claim 7 further comprising:

a power source mounted to the trailer and adapted to drive the submersible pump.

11. The mobile pump system of claim 10 wherein the power source is self-contained.

12. A mobile pump system comprising:

a wheeled trailer including a trailer frame;

an adjustable pipe system including a discharge pipe section, an intake pipe section and a swivel section mounted to the trailer frame and coupled between the intake pipe section and the discharge pipe section, wherein the swivel section allows the discharge pipe section to be pivoted about a discharge pipe pivot axis that is fixed with respect to the trailer frame and allows the intake pipe section to be pivoted, independently of the discharge pipe section, about an intake pipe pivot axis that is fixed with respect to the trailer frame; and a submersible pump mounted to the intake pipe section;

wherein the discharge pipe pivot axis and the intake pipe pivot axis are coincident.

13. A mobile pump system comprising:

a wheeled trailer including a trailer frame;

an adjustable pipe system including a discharge pipe section, an intake pipe section and a swivel section mounted to the trailer frame and coupled between the intake pipe section and the discharge pipe section, wherein the swivel section allows the discharge pipe section to be pivoted about a discharge pipe pivot axis that is fixed with respect to the trailer frame and allows the intake pipe section to be pivoted, independently of the discharge pipe section, about an intake pipe pivot axis that is fixed with respect to the trailer frame; and a submersible pump mounted to the intake pipe section;

wherein the discharge pipe pivot axis and the intake pipe pivot axis are parallel; and wherein at least one of the intake pine section and the discharge pipe section includes a hinge for allowing the pipe section to be rotated between a first position for pumping operation and a second position for transportation.

14. The mobile pump system of claim 7 wherein the swivel section comprises:

a first 90-degree elbow section having a discharge leg coupled to the discharge pipe section;

a second 90 degree elbow section having an intake leg coupled to the intake pipe section; and a coupling between the first 90-degree elbow section and the second 90-degree elbow section wherein the first and second 90-degree elbow sections can be rotated relative to each other.

15. A mobile pump system comprising:

a wheeled trailer including a trailer frame;

an adjustable pipe system including a discharge pipe section with a discharge pipe pivot axis, an intake pipe section with an intake pipe pivot axis and a swivel section coupled between the intake pipe section and the discharge pipe section; and a submersible pump mounted to the intake pipe section;

wherein the swivel section comprises a first elbow section having a discharge leg coupled to the discharge pipe section, a second elbow section having an intake leg coupled to the intake pipe section, and a coupling between the first elbow section and the second elbow section wherein the coupling is fixedly mounted to the trailer frame and the first and second elbow sections can be rotated relative to each other wherein at least one of the intake pipe section and the discharge pipe section includes a hinge for allowing the pipe section to be rotated between a first position for pumping operation and a second position for transportation.

16. The mobile pump system of claim 15 further comprising:

a first hydraulically actuated pivot means for pivoting the discharge pipe section about the discharge pipe pivot axis;

a second hydraulically actuated pivot means for pivoting the intake pipe section about the intake pipe pivot axis; and a hydraulic fluid supply system mounted to the trailer frame for supplying hydraulic fluid to the first and second hydraulically actuated pivot means pivot means.

17. The mobile pump system of claim 15 wherein the submersible pump is a hydraulic pump.

18. The mobile pump system of claim 15 further comprising a power source mounted to the trailer and adapted to drive the submersible pump.

19. The mobile pump system of claim 18 wherein the power source is self-contained.

20. The mobile pump system of claim 16 further comprising a power source mounted to the trailer and adapted to drive the hydraulic fluid supply system.

* * * * *